United States Patent [19]

Göessler

[11] 4,161,648

[45] Jul. 17, 1979

[54] ELECTRICAL RADIATION HEATER FOR A GLASS CERAMIC PLATE

[75] Inventor: Gerhard Göessler, Oberderdingen, Fed. Rep. of Germany

[73] Assignee: E. G. O. Elektro-Geraete Blanc und Fischer, Fed. Rep. of Germany

[21] Appl. No.: 738,517

[22] Filed: Nov. 3, 1976

[30] Foreign Application Priority Data

Nov. 14, 1975 [DE] Fed. Rep. of Germany ..... 2551137

[51] Int. Cl.[2] ..... H05B 3/68

[52] U.S. Cl. ..... 219/464; 219/463; 219/468; 338/279; 338/287

[58] Field of Search ..... 219/458, 460, 463, 464, 219/406, 532, 542, 552, 468; 338/278, 279, 280, 287, 282, 283; 13/25

[56] References Cited

U.S. PATENT DOCUMENTS

| | | | |
|---|---|---|---|
| 600,057 | 3/1898 | Ball | 338/280 |
| 1,233,183 | 7/1917 | Carter et al. | 338/281 X |
| 3,086,101 | 4/1963 | Scofield | 219/460 |
| 3,346,720 | 10/1967 | Siegla | 219/464 |
| 3,567,906 | 3/1971 | Hurko | 219/467 X |
| 3,612,826 | 10/1971 | Deaton | 219/453 |
| 3,612,827 | 10/1971 | Dills | 219/463 |
| 3,612,828 | 10/1971 | Siegla | 219/464 |
| 3,612,829 | 10/1971 | Evans et al. | 219/464 |
| 3,646,321 | 2/1972 | Siegla | 219/464 |
| 3,749,883 | 7/1973 | Vodvarlia et al. | 219/463 |
| 3,838,505 | 10/1974 | Doner | 219/464 X |
| 3,912,905 | 10/1975 | Giler | 219/460 |
| 3,984,615 | 10/1976 | Beck | 219/532 |

FOREIGN PATENT DOCUMENTS

| | | | |
|---|---|---|---|
| 250845 | 9/1947 | Switzerland | 338/280 |
| 196480 | 4/1923 | United Kingdom | 338/280 |

*Primary Examiner*—C. L. Albritton
*Assistant Examiner*—M. Paschall
*Attorney, Agent, or Firm*—Steele, Gould & Fried

[57] ABSTRACT

An electrical radiation heater for a glass ceramic plate, which serves as a cooking plate, comprises an electrical heating strip mounted on an insulating sheet. The heating strip is slit alternately from opposite edges to give it a zig-zag shape and is bent or curved so that it undulates in serpentine fashion. The strip is laid edge-on onto the insulating sheet and anchoring tabs integral with the strip penetrate the insulating sheet. The insulating sheet is laid on an insulating layer which is received in a flat bottomed supporting dish or tray and which is made from a good thermally insulating as well as electrically insulating material.

22 Claims, 8 Drawing Figures

ELECTRICAL RADIATION HEATER FOR A GLASS CERAMIC PLATE

The invention relates to an electrical radiation heater for a glass ceramic plate, which serves as a cooking plate, and more particularly to a radiation heater comprising a heating element mounted on an insulating sheet.

Such a radiation heater has already been proposed. A heater tape bent in serpentine fashion is laid edge-on on the insulating sheet. For conventional mains voltages the tape must be very thin which makes manipulation and fixing on the insulating sheet difficult. The board like insulating sheet also tends to bulge upwardly into the vicinity of the glass ceramic plate which can thermally endanger the plate and produces uneven heating conditions. In this connection it is mentioned that a basic feature of radiation heating is that a good distance is always maintained between the underside of the glass ceramic plate and the heating element. This reduces the risk of local over-heating of the glass ceramic plate and makes its heating more uniform. Owing to the reduced risk of local over-heating, it is possible to bring the temperature nearer to the critical temperature which could lead to damage of the glass ceramic plate.

A radiation heater for a glass ceramic plate is described in published German Patent Specification (Offenlegungsschrift) No. 2 165 569 in which heating conductors are guided in bridge like ceramic carriers or spacers and extend freely between these spacers. The heating conductors take the form of conventional filaments or wavy wires whose wave plane lies parallel to the glass ceramic plate. The spacers are received in a supporting dish or tray and are insulated at their underside and are pressed against the underside of the glass ceramic plate. With this construction, numerous ceramic moulded parts are required and the insertion of heating conductors is labour intensive. Furthermore, the heating conductors are always exposed at the points where they penetrate through the ceramic body to thermal conditions which are different from those in their free regions, thus not only affecting uniformity of heat but also endangering the heating conductors.

For this reason it has also become known practice to insert the heating conductors in spiral grooves in ceramic moulded parts and to hold them there by at least partially cementing. This too is relatively labour intensive and the inefficiently heat-insulating ceramic moulded part counteracts rapid and low thermal inertia heating.

The aim of the invention is therefore to provide an electrical radiation heater which, while being easy to manufacture and extremely reliable, is suitable for all conventional mains voltages and is operationally reliable.

In accordance with the present invention an electrical radiation heater for a glass ceramic plate, which forms a cooker plate, comprises a sheet which is made from high temperature-resistant insulating material and on which a heating conductor strip is mounted by means of anchoring tabs which engage at least partially through the sheet, the heating conductor strip being made from relatively thick material and being slitted alternately from opposite edges to give the conductor strip a zig-zag form, the zig-zag strip being bent back and forth into a serpentine shape and laid edge-on onto the insulating sheet.

The heater element thus undulates in two senses; it zig-zags in the "plane" of the strip and it is of serpentine form as seen edge-on.

Despite the relatively thick flat material, a sufficiently effective length of the heating conductor is obtained in order to limit the overall length of the serpentine strip to a reasonable value and to maintain in its arrangement sufficient gaps between the individual, preferably spiral, loops of the heating conductor strip. As a result of the slit points, the rigidity of the heating conductor strip is reduced in all directions and particularly in the vertical direction where the rigidity together with a tendency to curve too have a particularly adverse effect since it promotes upward bulging of the insulating sheet and movement towards the glass ceramic plate or a sensor placed therebetween.

The invention is further described, by way of example, with reference to the accompanying drawings, in which.

Figure 8:
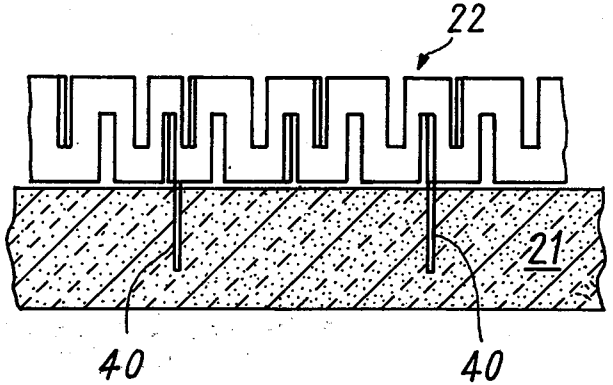
Figure 4:
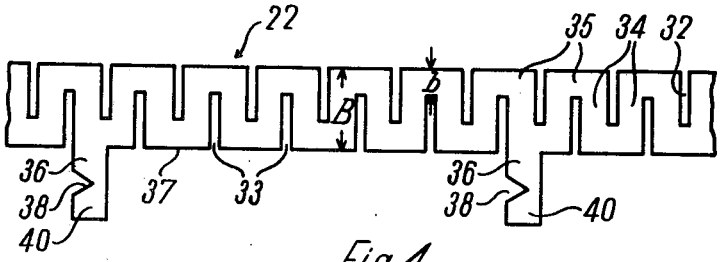
Figure 5:
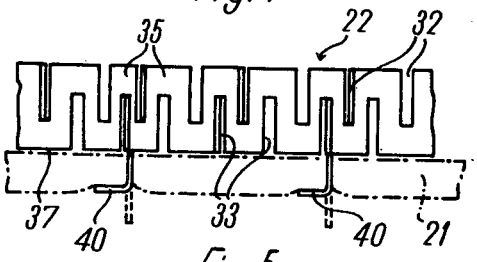
Figure 6:
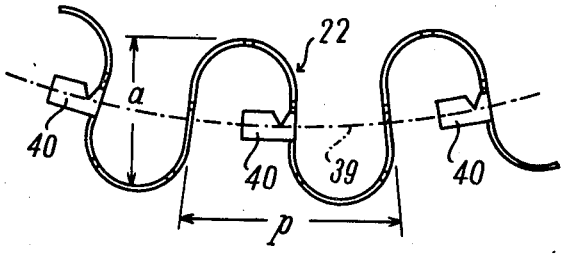
Figure 7:
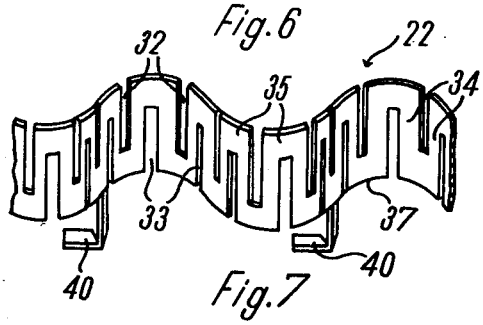

FIG. 4 is a view of a heating conductor strip directly after punching out but before being given its serpentine shape, FIG. 5 is a side view of the portion of the heating conductor strip which is shown in FIG. 4, after being given its serpentine shape and after mounting on the insulating sheet which is shown by dash dot lines, FIG. 6 is a view of the serpentine conductor strip as seen from below in FIG. 5, the insulating sheet being omitted, FIG. 7 is a perspective view seen obliquely from above of the portion of the serpentine heating conductor strip of FIGS. 5 and 6, and FIG. 8 is a view similar to FIG. 5 but showing an embodiment using an insulating sheet made from hardenable insulating substance.

Figure 1:
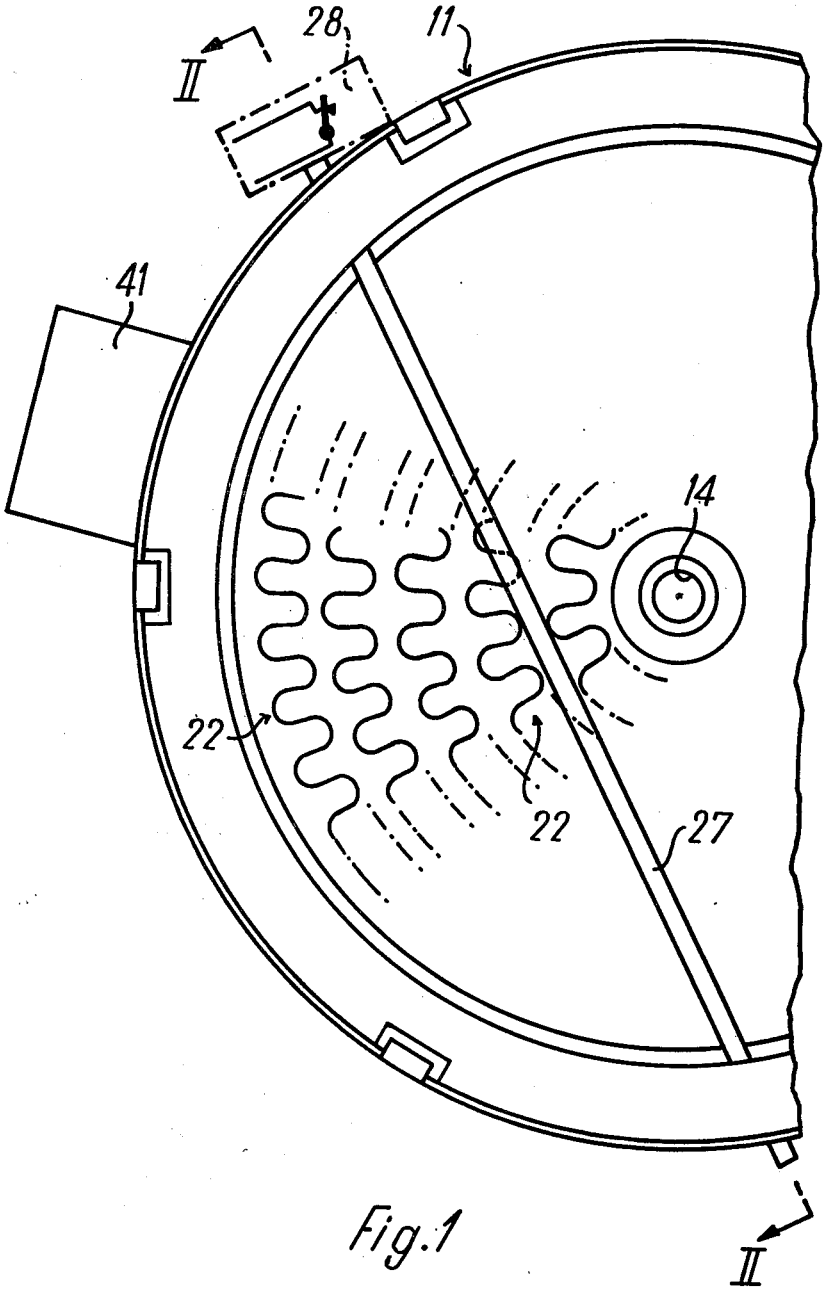
FIG. 1 is a plan view of a part of a radiation heater seen from above, i.e. from the glass ceramic plate.
Figure 2:
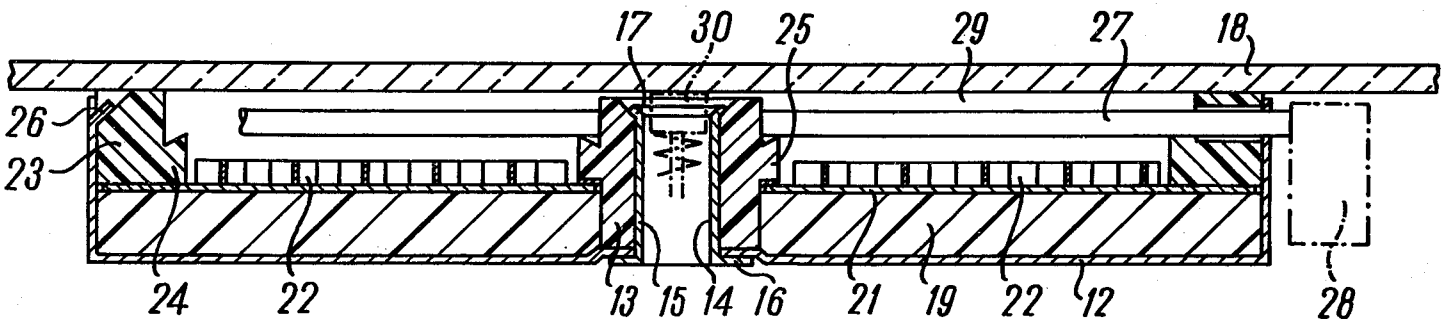
FIG. 2 is a section along the line II—II of FIG. 1

The radiation heating unit 11 shown in FIGS. 1 and 2 has a circular, flat-bottomed, 30 mm or less deep supporting dish 12 made of sheet metal in whose centre a central socket 13 is mounted. The central socket 13 has a central opening 14 through which a tube piece 15 protrudes, a lower flange 16 of said tube piece 15 being adjacent to the bottom of the supporting dish and an upper pressing or riveting portion 17 holding the central socket 13 in place. As is shown diagrammatically in FIG. 2 with dash dot lines, a heat sensor or thermostat probe 30 may be disposed inside the tube piece 15 and may be adjacent to the underside of a glass ceramic plate 18 below which the radiation heating unit 11 is disposed.

The bottom of the supporting dish 12 is covered by a thick insulating lining 19. This insulating lining is made from a highly heat-insulating temperature-resistant insulating material and may advantageously be a preformed part. The insulating lining can alternatively be manufactured by pressing the material into the supporting dish 12 which then forms a bottom-half mould. In this case, a finely dispersed silica obtained by flame pyrolysis is preferably used as an insulating material. A suitable material is one known by the name Aerosil and known as Micropor in its pressed form. This material has excellent thermal insulation properties but a relatively low mechanical strength, this however being unimportant in the arrangement of FIG. 2 since the insulating lining 19 is supported by the supporting dish 12.

An annular sheet 21, which has a structure of a relatively strong cardboard material made from highly temperature-resistant insulating material, surrounds the central socket 13 and lies on the insulating lining 19. Heating conductors 22 which are described in greater detail hereinafter are supported on the annular sheet 21. The material of the sheet 21 is a fibrous insulating material which is combined preferably with an inorganic, for example ceramic binding agent to form an insulating board. An aluminium oxide silicon dioxide fibre which is sold under the name Fiberfrax may be used for such purpose. Owing to the low stress exerted upon this sheet it is however alternatively possible to manufacture the material of the sheet using an organic binding agent which evaporates when first subjected to temperature.

In the edge region of the insulating lining 19 there is a ring 23 which is supported in the region of the outer periphery of the sheet 21 on said sheet and holds it down against the lining 19. A flange 25 of the central socket 13 serves the same purpose on the inner periphery of the annular sheet 21. Thus, the sheet 21 is held at its outer periphery and its inner periphery so that it is effectively prevented from bulging upwards.

The ring 23 has on its inner periphery a shoulder provided to increase the creeping current path. The ring is held at its outer periphery by bending sheet metal tabs 26 into corresponding recesses in the peripheral wall of the supporting dish 12. The upper face of the ring 23 lies adjacent to the inside of the glass ceramic plate 18 which is a hotplate of a domestic cooker. The glass ceramic which is used is a high temperature-resistant glasslike or ceramic material which is particularly known for its high resistance to thermal shock. Like the central socket 13, the ring 23 is a moulded body made from temperature-resistant insulating material which should have relatively good physical properties in order to be able to fulfill its bearing and supporting functions. These moulded bodies may be, for example, made from the above mentioned fibrous insulating material (commercial name "Fiberfrax") which is pressed with inorganic and particularly ceramic binding agents into moulded bodies.

Figure 3:
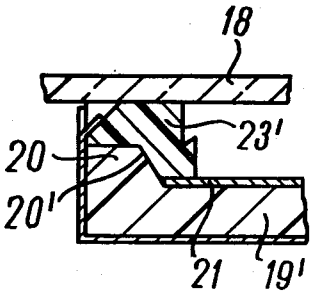
FIG. 3 is a detail sectional view illustrating a variant of FIG. 2.

Since this material has an excellent mechanical strength but as concerns its thermally insulating properties is substantially poorer than the above mentioned silica material, it is possible as FIG. 3 shows to modify the construction so that the silica material lining 19' practically covers the entire upwardly directed rim of the supporting dish 12. The ring 23' is L-shaped in section and extends upwardly from the lining 19' towards the glass ceramic plate 18 and inwardly towards the interior 29 to hold down the annular sheet 21. Provision is therefore made for optimal thermal insulation in the peripheral region of the supporting dish 12 without jeopardising the overall mechanical strength of the arrangement. Bevelling 20' on the edge of the lining 19' and on the ring 23' improves the mechanical strength.

It may be seen from FIGS. 1 and 2 that a rodlike heat sensor probe 27 of a temperature limiter 28 (shown by dash dot lines) projects transversely through the interior 29 of the unit and extends between the underside of the glass ceramic plate 18 and the heating conductors 22 almost over the whole diameter of the unit. It may also be seen from FIG. 1 that, in order to allow on the one hand the above-mentioned central probe 30 and on the other hand the thermometer probe 27 to provide to the maximum extent generally valid values, the central probe is slightly offset from the centre. The temperature limiter 28 basically serves to protect the glass ceramic plate. It is adjusted in a fixed manner and discontinues heating on attainment of a temperature likely to damage the glass ceramic plate. The central probe is however also dependent upon the temperature of the cooking receptacles on the glass ceramic plate 18 and its associated regulating device may be adjustable.

The illustrated arrangement provides a compact radiation heating unit which, while of the simplest construction, offers an optimal thermal utilisation and protection against overheating of the glass ceramic plate. The unit is particularly light and dispenses, with the exception of a light support in the edge region, with a support for the glass ceramic plate which is consequently endangered mechanically to a substantially lesser extent since solid parts placed below reduce its impact strength by limiting the resilient transverse suspension. The unit may be fixed in any manner, for example by means of a pressure spring on the underside of the glass ceramic plate.

FIGS. 4 to 7 show the heating conductor 22 in detail. This is a strip of electrical resistance material whose overall width is between 3 mm and 4 mm and whose thickness is in the region of magnitude of 0.1 mm to 0.3 mm. In special cases, the thickness may be as little as 0.05 mm. This strip is given a zig-zag shape by means of slits or notches 32, 33 which extend alternately from opposite edges of the band and which are produced by punches. The strip therefore comprises successive U-bends which are open upwards or downwards respectively, the transversely extending limbs 34 preferably having the same width as the portions 35 extending longitudinally of the strip. It has been proved that the heating conductor is particularly advantageous as regards its manufacturability and functions if the ratio of the overall strip width B to effective heating conductor width b is more than 2.5 and less than 3.5. A ratio of approximately 3, i.e. a ratio of strip width to heating conductor cross-section of approximately $\frac{1}{3}$, has proved particularly advantageous.

It may also be seen from FIG. 4 that anchoring tabs 36 adjoin the lower edge of the heating conductor strip 22 and are disposed at a distance of several zig-zag loops from one another. Some distance from the lower edge 37 of the strip they have a triangular notch 38 which forms a bending point.

Whereas in FIG. 4 the heating conductor stamped preferably in this form from a flat material is shown in its flat manufactured form, FIG. 5 to 7 illustrate the final used form wherein the strip is bent in serpentine fashion, this form for example comprising two adjacent semi-circular curves each of which is curved towards the other side. The central portions interconnecting the two curves lie perpendicular to the central line 39 of the serpentine strip. In a preferred embodiment, the strip has a width B of 3 mm to 4 mm, preferably 3.5 mm, a wave length p of approximately 10 mm and a wave amplitude a of approximately 7.5 mm, and the width of each slit 32, 33 is not more than 0.4 mm. It may be seen that the serpentine shape is such that the fixing tabs are always located at the same points in the loops and in fact particularly advantageously on the central line 39 of the serpentine strip. It is also particularly preferred that an anchoring tab 36 is provided at each wave period p. It may be seen that in this way on the one hand a sufficient number of anchoring tabs is provided to ensure secure fixing of the strip and on the other hand unrestricted expansion during heating is possible in all directions without excessively stressing the anchoring tabs.

It may be seen from FIG. 5 that the anchoring tabs 36 pass through the annular sheet 21 (shown by dash dot lines) and their region placed below the notch 38 is bent over to hold the heating conductor strip 22 against the sheet 21.

Mounting of the heating conductor strip 22 on the annular sheet 21 is particularly easy. The preformed serpentine strip is formed into a spiral, as may be seen from FIG. 1, and is placed in an auxiliary appliance with the anchoring tabs 36 directed upwardly. The annular sheet 21 is placed over the then upwardly pointing tabs. Because the material of the heating conductor strip may be relatively thick, these tabs 36 are sufficiently strong to penetrate the board-like material of the annular sheet 21. A rotary tool may then be used to press down the lugs 40 formed beyond the notches 38 from the straight shape shown in dashed lines into the bent shape shown by fall lines.

The heating conductor unit thus manufactured forms a unit which is ready for installation, and is inserted into the supporting dish already provided with the lining 19 and is fixed by the ring 23 and possibly the central socket 13. Electrical connection to the heating strip is effected by means of a connecting part 41 (FIG. 1).

Numerous modifications are possible within the framework of the invention. Thus, for example, the insulating lining 19 which in the embodiment is a moulded part formed in the supporting dish may alternatively be inserted as a separately produced moulded part or as a part cut from a plate. A central probe is not necessary in all embodiments. Particularly in smaller units, the sheet 21 does not require a central support owing to the advantageous properties of the heating conductor strip.

FIG. 8 shows an embodiment in which, instead of the sheet of board like material, a sheet 21' made from a hardenable insulating substance is used. An insulating substance may for example be used such as is used for embedding the filaments in electrical hotplates. Such ceramic substances contain quartz, $Al_2O_3$, $SiO_2$ and similar high temperature-resistant minerals. In their manufactured state they can be agitated until they become pasty so that it is possible to press the anchoring tabs 36 into the substance. The latter may then be hardened under the action of heat to form an extraordinarily strong sheet which with the heating conductor strip 22 produces an easily manipulable unit. The sheet 21' may have any desired shape at its underside.

It may alternatively be advantageous to divide the heating conductor strip 22, i.e. to provide two independently connectible heating resistors to enable smoother regulation of the basically low capacity heating.

I claim:

1. An electrical radiation heater for a glass ceramic plate, which forms a cooking plate, comprising:

support means for said glass ceramic plate; a lining made from highly thermally insulating, temperature-resistant material disposed in said support means;

a thin sheet, having a substantially flat upper surface consisting of high temperature-resistant insulating material, said sheet comprising a fibrous material and an inorganic binding agent, said sheet being disposed beneath said ceramic plate, disposed on said lining;

a heating conductor strip disposed on said sheet, insulating and temperature resistant ring means located in said support means and engaging over the outer periphery of said sheet to hold the latter down on said lining at its outer periphery, said sheet and said ring means having greater mechanical strength and lower thermal insulating characteristics than said lining; said heating conductor strip being relatively thick and having slits extending alternately from opposite edges thereof to define a zig-zag shape in said strip, said heating conductor strip furthermore having a back and forth curvature to define a serpentine form and being in edge-on engagement with said upper surface;

a plurality of anchoring tab means formed integrally with said conductor strip, said tab means projecting from said sheet engaging edge at spaced intervals and being at least partially pierced through said insulating sheet; and, electrical terminal connection means for said conductor strip.

2. A radiation heater according to claim 1, in which said anchoring tab means consist of anchoring tabs disposed in the region of the longitudinally central axis of the serpentine curvature of said strip.

3. A radiation heater according to claim 1, in which said anchoring tab means consist of anchoring tabs of which one is provided for each full wave period of the serpentine curvature of said strip.

4. A radiation heater according to claim 1, in which said anchoring tab means comprise anchoring tabs adapted to punch through the insulating sheet.

5. A radiation heater according to claim 4, in which said anchoring tab means comprise anchoring tabs each of which has a notch formed therein to define a hand line along which the tab is bent after penetration through the insulating sheet.

6. A radiation heater according to claim 1, in which the heating strip has an overall width and an effective conductor width which are so dimensioned that the ratio of the overall width to the effective heating conductor width is not less than 2.5 and not more than 3.5.

7. A radiation heater according to claim 1, in which the overall width of the heating strip is between 3 mm and 4 mm.

8. A radiation heater according to claim 1, in which the slits in the heating conductor strip have a width of not more than 0.4 mm.

9. An electrical radiation heater for a glass ceramic plate which forms a cooking plate, comprising:

supporting dish means;

a lining made from a highly thermally insulating temperature-resistant material disposed in said supporting dish means;

a substantially flat member of high temperature-resistant insulating material disposed on said lining;

heating conductor means secured to one surface of said flat member;

electrical terminal connection means for said heating conductor means; and, insulating and temperature-resistant ring means located in said supporting dish means and engaging over the outer periphery of said flat member to hold the latter down on said lining at its outer periphery, said flat member and said ring means having greater mechanical strength and lower thermal insulating characteristics than said lining material.

10. A radiation heater according to claim 9, in which the highly thermally-insulating, temperature-resistant insulating material is a material made from a microporous finely dispersed silica.

11. A radiation heater according to claim 9 in which said insulating ring is adapted to rest against the underside of the glass ceramic plate.

12. A radiation heater according to claim 11, in which said ring has a substantially L-shaped cross section and in which the lining has in the region of its outer periphery an upward projecting edge which is overlapped upwardly and inwardly by said ring.

13. A radiation heater according to claim 9, in which said insulating part consists of a moulded part of a fibrous inorganic substance.

14. A radiation heater according to claim 9, in which said insulating sheet has a generally central aperture and further comprising an insulating part engaging the inner periphery of said insulating sheet to hold the latter down on said lining at its inner periphery, said insulating part being temperature-resistant and having relatively good physical properties.

15. A radiation heater according to claim 14, in which said insulating part which engages over the inner periphery of the insulating sheet comprises a central socket having a flange.

16. A radiation heater according to claim 15, in which said central socket has an opening for mounting a temperature sensor.

17. A radiation heater according to claim 16, which includes a tube piece which projects through the opening in the socket and supports the latter.

18. A radiation heater according to claim 1, in which said insulating sheet has a generally circular outer periphery and the serpentine heating conductor strip is mounted thereon spirally.

19. A radiation heater according to claim 1, in which the overall depth of the unit below the glass ceramic plate is at most 30 mm.

20. A radiation heater according to claim 1, in which the insulating sheet comprises a board-like insulating material.

21. A radiation heater according to claim 1, in which the insulating sheet consists of a hardenable insulating substance in which the anchoring tab means are impressed while the insulating substance is still plastic.

22. A radiation heater according to claim 1, in which the thickness of the heating strip is between 0.05 mm and 0.3 mm.

* * * * *